US005092308A

United States Patent [19]

Sheffield

[11] Patent Number: 5,092,308

[45] Date of Patent: Mar. 3, 1992

[54] COMPOUND ARCHERY BOW WITH ADJUSTABLE SIGHT AND HAND ANCHOR

[76] Inventor: Thomas H. Sheffield, 20 Shirley Ct., Archer, Fla. 32618

[21] Appl. No.: 617,911

[22] Filed: Nov. 13, 1990

Related U.S. Application Data

[63] Continuation of Ser. No. 403,110, Sep. 5, 1989, abandoned.

[51] Int. Cl.[5] ..... F41B 5/00

[52] U.S. Cl. ..... 124/25; 124/35.2; 124/87; 124/91

[58] Field of Search ..... 33/233, 234, 246, 260, 33/265; 124/23.1, 24.1, 25, 25.6, 31, 35.1, 35.2, 44.5, 87, 88

[56] References Cited

U.S. PATENT DOCUMENTS

| | | | |
|---|---|---|---|
| 2,351,103 | 6/1944 | Brown | 124/87 X |
| 2,714,377 | 8/1955 | Mulkey | 124/23 R |
| 3,015,328 | 1/1962 | Ryder | 124/24 R X |
| 3,512,512 | 5/1970 | Wentz | 124/24 R |
| 3,557,769 | 1/1971 | Hofmeister | 124/88 X |
| 3,667,444 | 6/1972 | Depatie et al. | 33/265 X |
| 3,750,641 | 8/1973 | Ramsey | 124/23.1 |
| 4,178,905 | 12/1979 | Groner | 124/DIG. 1 X |
| 4,237,615 | 12/1980 | Bracknell | 33/265 |
| 4,282,850 | 8/1981 | Warnicke | 124/24 R |
| 4,476,845 | 10/1984 | Richard | 124/35.2 |
| 4,478,203 | 10/1984 | Hayes | 124/DIG. 1 X |
| 4,553,338 | 11/1985 | Le Beau | 124/87 X |
| 4,602,437 | 7/1986 | Berthiaume | 33/265 |
| 4,625,420 | 12/1986 | Figured | 124/87 X |
| 4,625,705 | 12/1986 | Willits | 124/35 A |
| 4,787,361 | 11/1988 | Vyprachticky | 124/24 R X |
| 4,930,485 | 6/1990 | Kopper | 124/23.1 X |

OTHER PUBLICATIONS

"Tie the Loop" article, *Bow and Arrow*, Apr. 1986, pp. 46–47.

*Primary Examiner*—Peter M. Cuomo
*Assistant Examiner*—Jeffrey L. Thompson
*Attorney, Agent, or Firm*—Dowell & Dowell

[57] ABSTRACT

An archery bow is provided with a tubular sight 15 with internal distance adjustment, a bowstring handle 2 with a trigger-release and a hand anchor 1 for holding the bowstring until released. An arrow-centering indentation 16 with resilient centering means 13–14 is provided at the opposite side of the bow from a bow handle 32 extended in a manner that the bow can be held horizontally like a crossbow for greater stability, convenience and ease of operation.

20 Claims, 2 Drawing Sheets

COMPOUND ARCHERY BOW WITH ADJUSTABLE SIGHT AND HAND ANCHOR

This application is a continuation of application Ser. No. 07/403,110, filed 09/05/89 now abandoned.

BACKGROUND OF THE INVENTION

This invention relates to archery bows and in particular to a tubular adjustable sight and a hand-anchor extended from the bow for maximized accuracy and ease of operation.

Traditionally, bowstrings of archery bows have been grasped by the fingers of a hand and held without assistance to the fingers or to the hand until the bowstring is released. This is a relatively unstable physical condition for accurate and convenient archery. It is a condition for which effective distance-adjustable sights have not been devised.

When bowstrings are held mechanically until released, a crossbow is formed. The device is no longer an archery bow. This invention provides advantages of crossbows to archery bows without mechanical holding of the bowstring to become a crossbow.

Previously when tubular or telescopic sights have been employed for either crossbows or archery bows, the entire tube or telescope has been rotatable vertically for distance adjustment and horizontally for windage adjustment. Typical have been U.S. Pat. No. 4,528,973 (Rasmussen) in 1985 and U.S. Pat. No. 4,616,623 (Williams) in 1986. In the Rasmussen patent, a sighting tube was adjustable horizontally and vertically in brackets on an archery bow. In the Williams patent, a telescope was likewise adjustable horizontally and vertically in brackets on an archery bow.

Numerous crossbow configurations and operation mechanism have been devised during the millenniums of their use. Convenience, mechanical advantage for cocking the bowstring in a trigger mechanism and accuracy advantages have been primary objectives. Typical patents of recent crossbow advancements have been U.S. Pat. No. 4,294,222 (Pelsue) 1981; U.S. Pat. No. 4,603,676 (Luoma) 1986; U.S. Pat. No. 4,649,891 (Bozek) 1987; U.S. Pat. No. 4,772,318 (Yankey) and; U.S. Pat. No. 4,796,598 (Jones) 1989. The Pelsue patent provided a hinged fold-away bowstring holder and a pistol-grip handle. The Luoma patent adapted the conventional washer-tube jack mechanism for pulling the bowstring and a convenient release mechanism for a crossbow. The Bozek patent provided an advanced leverage-changing mechanism that increased mechanical advantage and speed of bowstring travel progressively after release of the bowstring for a gun-but crossbow bolt-guide ways. The Yankey patent provided a spring-loaded bolt stabilizer. The Jones patent provides an arrow-holding launch ramp that disengages and retracts out of the path of stabilizer members on a bolt or arrow of a crossbow. All of these patents relate to a crossbow, however, and they are different from the Applicant's advancements of an archery bow or what could be termed a hybrid archery bow.

SUMMARY OF THE INVENTION

A primary object of this invention is to provide an archery bow with the stability and accuracy of a crossbow while maintaining the convenience and hand-operated features of an archery bow.

Another object is to provide a tubular sight with internal adjustment that is protected from extraneous ambient conditions.

Another object is to provide a quick and convenient distance adjustment of the tubular sight.

Another object is to provide a tube-framed, peep-sight vision of targets.

Another object of this invention is to provide a hand-anchor for grasping a bowstring and holding it by hand until released.

Another object is to provide a reliably, centrally positioned bow-string holding means.

Another object is to provide a reliable straight alignment of a resilient bow-centering means with a bowstring holding means.

Another object is to provide a bowstring holding means that does not cut or injure finger from holding and releasing the bowstring.

Another object is to provide horizontal positioning of an archery bow to allow a user to be in a horizontal position when using it.

Another object is to provide a metal contact of a hand-held bowstring hook with a bowstring to reduce wear.

Another object is to provide insertion of a bowstring into the aft end of an arrow without interference with fingers or a bowstring hook.

Another object is to reduce strain of upper body, arms, hands and fingers for using an archery bow.

Another object is to provide a wide range of shooting positions encountered in archery hunting, such as sitting, lying leaning and variously bracing oneself.

Another object is to make the use of archery bows sufficiently convenient and easy to operate so that less muscular individuals and partially handicapped individuals can participate in their use and the recreation made available thereby.

The present invention accomplishes the above and other objects by providing an archery bow with a tubular sight with internal distance adjustment, a bowstring handle with a trigger-release and a hand anchor for holding the bowstring until released. An arrow-centering indentation with resilient centering means is provided at the opposite end of the bow from a bow handle extended in a manner that the bow can be held horizontally like a crossbow for greater stability, convenience and ease of operation.

BRIEF DESCRIPTION OF THE DRAWINGS

The accompanying drawings of the invention are as follows.

DETAILED DESCRIPTION OF THE PREFERRED EMBODIMENT

Figure 1:
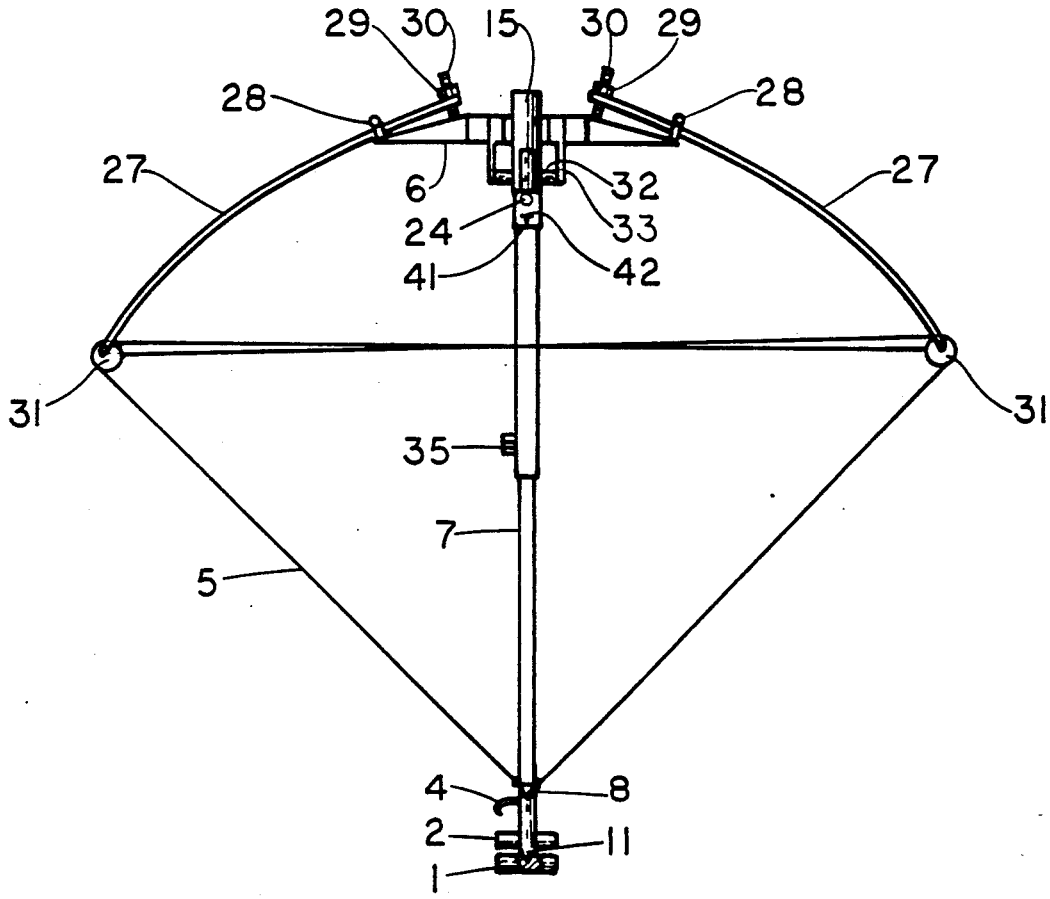
FIG. 1 is a top view with hand anchor attached.
Figure 6:
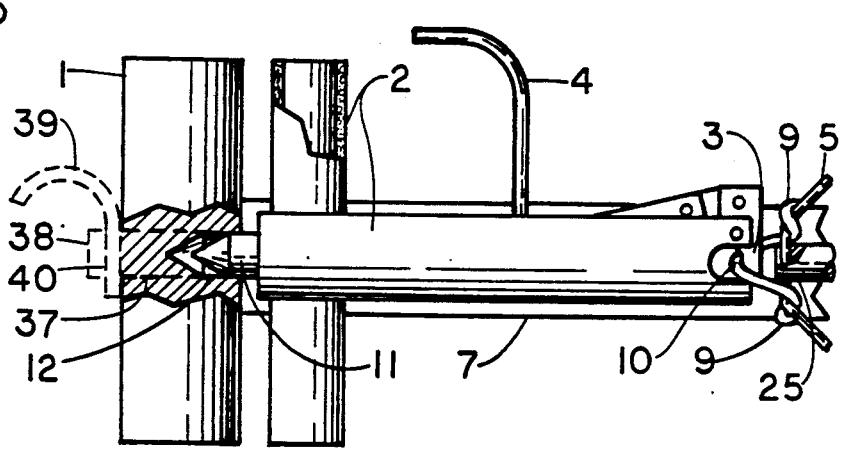
FIG. 6 is a cutaway sectional top view of the hand-anchoring and trigger-operated bowstring-holding holder.
Figure 7:
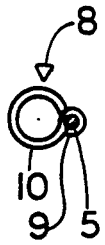
FIG. 7 is a sectional view of a metal bowstring loop insertable into a trigger-operated bowstring-holding holder.

Preferred embodiments of this invention are described in relation to numbered components in working relationships as follows:

Referring first to FIGS. 1, 6 and 7, a hand-support anchor member 1 supports the base of an archer's hand while the archer's fingers hold the arms of a T-shaped anchor handle 2. A bowstring hook 3 is trigger-releasable with trigger 4 to release bowstring 5. The hand-support anchor member 1 is attachable optionally to and extendable selective distances from a bow base 6 with anchor extension 7.

A steel-wire bowstring hook-holder member 8 is attachable to the bowstring with bowstring loops 9 around the bowstring and a central right-angled hook-engagement loop 10 that is bent at right angles from the direction of the bowstring 5 in passing through the bowstring loops 9. The bowstring hook 2 can be a conventional brace-alignment mechanism or other type of triggered bowstring-release mechanism.

An anchor-handle location member 11 is extendable from the opposite side of the T-shaped anchor handle 2 and positionable in an anchor-handle location orifice 12 to provide steady alignment of the anchor handle 2 and bowstring hook-holder member 8 with bottom resilient arrow-centering member 13 and side resilient arrow-centering members 14. This alignment also aligns with sight-enclosure tube 15. A bow-base indentation 16 is provided to permit the arrow-centering members 13 and 14 and an arrow inserted therein to be in the plane of travel of the bowstring.

Figure 2:
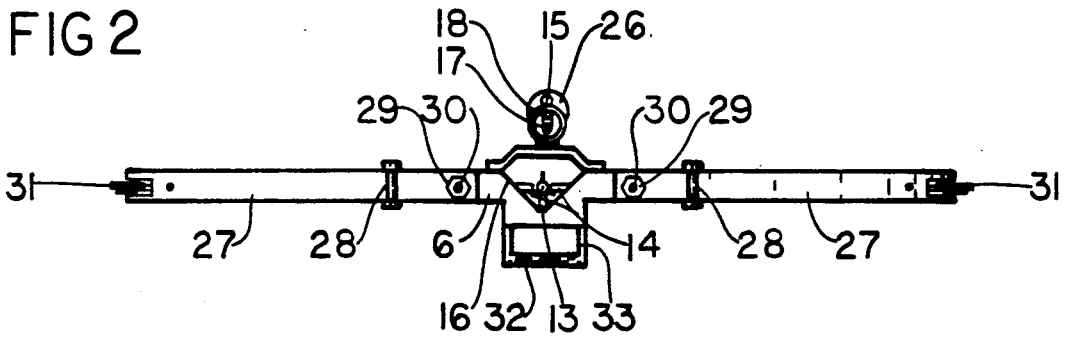
FIG. 2 is a front view with or without the hand anchor attached.

A feature that can be designed into this arrow-centering means is space between the bottom and side resilient members 13 and 14 to allow passage of a three-feathered arrow. The two bottom feathers can pass between the bottom and the two side members while the top feather passes through vertically as illustrated in FIG. 2.

Figure 4:
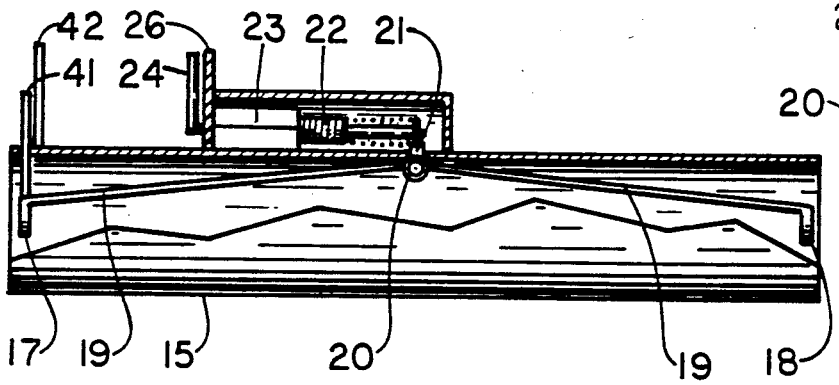
FIG. 4 is a cutaway side view of the sighting portion of the invention.
Figure 5:
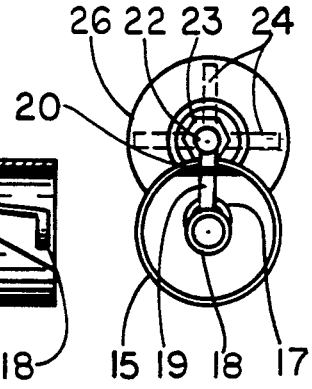
FIG. 5 is a front end view of the sighting portion of the invention.

Referring now to FIGS. 4 and 5 more particularly and to all other FIGS. in relation thereto, sight-enclosure tube 15 is provided with a rear sight 17 and a front sight 18 which are positioned at respective ends of a Y-shaped sight rod 19. Sights 17 and 18 can both be peep sights or the front sight may be optionally a "point" sight. Other sight options also may be employed. The front and rear sights are varied in distance from the bow base 6 by means of a sight-rod pivotal attachment 20 and a sight-rod adjustment member 21 that is extendable through a wall of the sight-enclosure tube 15 to sliding contact with an outside-threaded member 22 that is in thread-engagement relationship to an inside-threaded member 23 that, in turn, is attachable to the outside periphery of the sight-enclosure tube 15. The inside-threaded member is rotatable in either direction by a hand-rotatable crank member 24. Rotation of the outside-threaded member in one direction causes the sight-rod adjustment member 21 to travel towards the front sight 18 and thereby cause the front sight to travel closer to the bow base and the rear sight to travel away from the bow base. Rotating the outside-threaded member 22 in the opposite direction with the crank member 24 causes the front and rear sights, 18 and 17, to travel in the opposite direction in relation to distance from the bow base as a reference point.

When the rear sight 17 is relatively further from the bow base 6 than the front sight 18, the bow base 6 must be raised and the hand-support anchor member 1 or the T-shaped anchor handle 2 separately from the hand-support anchor member 1 if used separately, must be lowered relatively in order to align a target with both sights 17 and 18 visually in the sight-enclosure tube 15. This causes an arrow 25, illustrated in FIG. 8, to be inclined at a steeper angle and, therefore to travel farther. Reversing this distance relationship of the sights 17 and 18 from the bow base 6 has the opposite effect of decreasing range. Preferably, the length of the sight-rod-adjustment member 21 and the linear travel per revolution of threads of the inside-threaded member 23 in the outside-threaded member 22 are such that a one-half turn of crank member 24 causes the sights to traverse a complete range of distance from top to bottom of the sight-enclosure tube 15. This would allow the crank 24 to be at a vertical position when the sighting is level and to be at one side when sights are set high and at the opposite side when the sights are set low. Such positioning of the crank 24 facilitates ease of sighting by relative positioning which can be made incremental around the outward edge of a sight plate 26.

These sighting factors are applicable to incline angles less than 45 degrees. For angles greater than 45 degrees, increase incline decreases range as for mortar and high-angle artillery "lobbing" effects. But such inclines would be out of sight vision and ineffective for accuracy.

Resilient bow members 27 are pivotally attached to the bow base 6 with bow pivot members 28 and adjusted for tension with tension nuts 29 on tension bolts 30. Rotating the tension nuts 29 in a rotational direction that causes them to travel towards the bow base 6 increases tension, and rotating them in the opposite direction decreases tension of a bow against the bowstring 5.

A conventional compound bowstring with off-centered pulley wheels 31 can be employed to provide increasing tension and speed at terminal ends of bowstring travel and thereby increase speed of arrows.

In FIGS. 1-3 and 8, a bow handle 32 is extended parallel to the plane of the bow 27 between handle-support members 33. This parallel arrangement allows the bow to be held horizontally like a crossbow for increased stability and more optional archery positions. The handle member 33 also can be vertically extended like a pistol handle at right angles to the axis of the bow members to provide the same positioning option for operation but slightly less stability.

Figure 3:
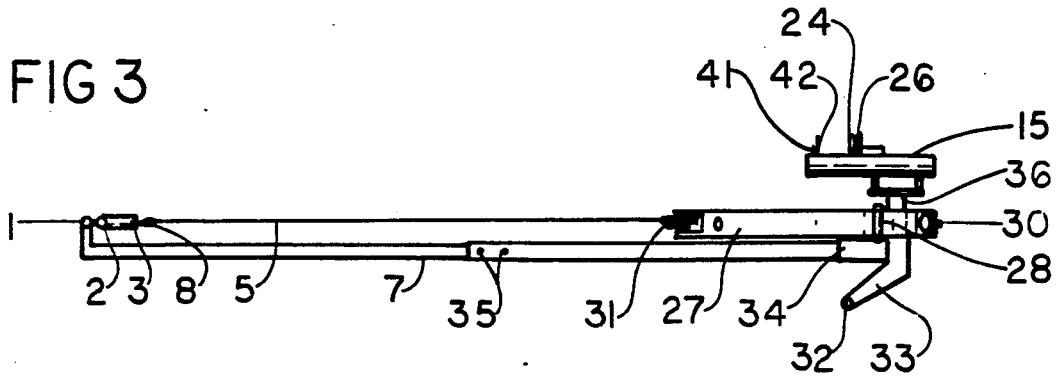
FIG. 3 is a side view with the hand anchor attached.
Figure 8:
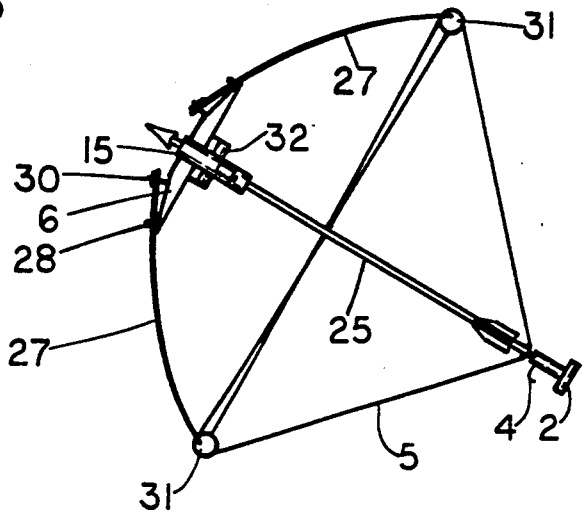
FIG. 8 is a perspective view without the hand anchor attached.

Referring to FIGS. 1, 3 and 8, the anchor extension 7 can be attachable at attachment base 34. It can be extendible to selective distances by such means as telescoping inside of a larger-diameter members and positioned rigidly with such means as set screws or bolts 35. When the hand-support member 1 is removed by disengaging the anchor extension 7 from the bow base 6, the bow is operated as illustrated in FIG. 8.

Referring to FIGS. 1-3, the sight-enclosure tube 15 can be made swivelable for windage adjustment also with optional tube swivel attachment 36. Swiveling the sight-enclosure tube clockwise adjusts for left windage and swiveling it counterclockwise adjusts for right windage.

Referring to FIG. 6, this archery bow can be converted to crossbow operation, if desired, by attachment of the T-shaped anchor hand 2 to the hand-support anchor member 1. The conversion attachment can be achieved by extending anchor-handle-location orifice 12 through hand-support anchor member 1 to become a crossbow-conversion orifice 37. The anchor-handle location member is extended further to become a crossbow conversion bolt 38. To retain the conversion bolt 38 in place, a conversion pin 39 is insertable into conversion pin orifice 40. The conversion bolt also could be threaded and held in place by a nut or channeled at each side and held in place by a flat U-shaped pin.

When operating this invention in optional crossbow mode, the horizontal bow handle 32 can be used as a foot stirrup to allow use of both hands for cocking the bowstring. The T-shaped bowstring handle 2 provides increased gripping capacity for cocking a bow when it has been increased in tension with tension nuts 29 and the hand-support anchor member has been extended to a sufficient length to require increased work-load for cocking. In typical crossbow practice, an arrow 25 or "bolt" can be inserted after cocking has been achieved.

Figure 9:
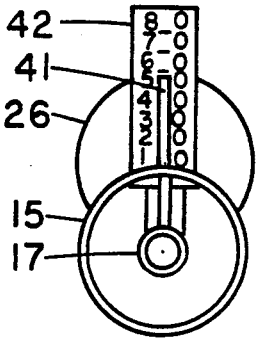
FIG. 9 is a rear view of the sight-enclosure tube with a range-finder included.

Referring to FIGS. 1, 3, 4 and 9 a sophisticated range-setting means that can be employed with or without this crank orientation is extension of range indicator 41 vertically from the rear sight 17 through the wall of the sight-enclosure tube 15. Then a range scale 42 can be positioned ahead of the indicator 41 with the range distances indicated, such as 10-to-80 yards as illustrated in FIG. 9. These yardage indications would apply for a particular setting of the anchor extension 7.

For most purposes, this fixed setting would be appropriate. However, for stronger individuals with greater strength to pull the bowstring out further to a longer setting of the anchor setting 7 and for less muscular individuals without sufficient strength to pull the bowstring to the setting distance for which the distance indicators are callibrated, the yardage indicators would not apply. The crank setting would be more appropriate but would require greater familiarity for accuracy.

As will be apparent to those skilled in the art to which this invention appertains, a variety of forms and modifications of this invention can be devised. All such forms and modifications thereof as are foreseeable within the following claims are included in this invention.

I claim:

1. An archery bow for shooting arrows having tip and rear end portions which includes a bow having a central portion and end portions with a bowstring being operatively connected to the end portions so that the end portions may be flexed relative to the central portion and wherein an extension member is connected at one end to the central portion of the bow and which includes an opposite end which extends rearwardly of the bow, the improvement comprising; a first handle means which is engageable by the palm of an individual's hand, means for connecting said first handle means to the opposite end of the extension member, said first handle means including alignment means therein; second handle means for engaging the bowstring having a locator member extending toward said first handle means, said locator member being selectively seated within said alignment means to thereby positively align the rear portion of an arrow both horizontally and vertically with respect to said first handle means whereby the alignment of arrows relative to the archery bow is uniformly assured.

2. The archery bow of claim 1 in which said first handle means is oriented generally parallel to the bow and transversely to the extension member, and said alignment means includes an opening in said first handle means in which said locator member is selectively seated.

3. The archery bow of claim 1 in which said first handle means is oriented generally parallel to the bow and transversely to the extension member, said second handle means having finger engaging portions extending generally parallel to said first handle means and having a first end portion extending from one side of said finger engaging portions and away from said first handle means, a trigger release means carried by said first end portion for selectively engaging the bowstring, and said locator member extending from the opposite side of said finger engaging portions.

4. The archery bow of claim 3 in which said alignment means includes an opening in said first handle means, said locator member being slidably receivable within said opening in said first handle means.

5. The archery bow of claim 4 in which said locator member includes a tapered end portion extending outwardly therefrom which is receivable within said opening in said first handle means.

6. The archery bow of claim 4 in which said second handle means is T-shaped.

7. The archery bow of claim 6 in which said archery bow includes a bow handle, said bow handle being connected to the central portion of the bow and extending generally parallel thereto and oriented in spaced relationship outwardly below the extension member when the archery bow is oriented in a horizontal position.

8. The archery bow of claim 7 in which said opening is in the form of a hole in said first handle means.

9. The archery bow of claim 8 in which said hole extends through said first handle means, said locator member including an extension portion which extends through said hole, and means for retaining said extension portion in fixed relationship relative to said first handle means.

10. The archery bow of claim 9 including an arrow centering device along the central portion of the bow.

11. The archery bow of claim 6 including an arrow centering device along the central portion of the bow.

12. The archery bow of claim 11 in which said opening is in the form of a hole in said first handle means.

13. In an archery bow for shooting arrows which includes a bow having a central portion and end portions, a bowstring being operatively connected to the end portions so that the end portions may be flexed relative to the central portion of the bow and wherein an extension member is connected at one end to the central portion of the bow and which includes an opposite end which extends rearwardly of the bow, the improvement comprising; a first handle means which is engageable by the palm of an individual's hand, means for connecting said first handle means to the opposite end of the extension member, said first handle means including an alignment opening therein for positively aligning the rear portion of an arrow, both horizontally and vertically, with respect thereto, a second handle means having finger engaging portions extending generally parallel to said first handle means and having first and second end portions, said first end portion having means for selectively engaging the bowstring and said second end portion of said second handle means being engageable within said opening whereby the alignment of arrows relative to the archery bow is uniformly assured.

14. The archery bow of claim 13 in which said second handle means is generally T-shaped.

15. In an archery bow for shooting arrows which includes a bow having a central portion and end portions, a bowstring being operatively connected to the end portions so that the end portions may be flexed relative to the central portion of the bow and wherein an extension member is connected at one end to the central portion of the bow and which includes an opposite end which extends rearwardly of the bow, the improvement comprising; a first handle means which is engagable by the palm of an individual's hand, means for connecting said first handle means to the opposite end of the extension member, said first handle means including an alignment opening therein for positively aligning the rear portion of an arrow, both horizontally and vertically, with respect thereto, said first handle means being oriented generally parallel to the bow and transversely to the extension member, a second handle means having finger engaging portions extending generally parallel to said first handle means and having first and second end portions, trigger release means carried by said first end portion for selectively engaging the bowstring, and said second end portion of said second handle means being engagable within said opening.

16. The archery bow of claim 15 in which said second handle means is T-shaped.

17. The archery bow of claim 16 in which said archery bow includes a bow handle, said bow handle being connected to the central portion of the bow and extending generally parallel thereto and oriented in spaced relationship outwardly below the extension member when the archery bow is oriented in a horizontal position.

18. An archery bow which includes a bow having a central portion and end portions with the bowstring being operatively connected to the end portions so that the end portions may be flexed relative to the central portion, the improvement comprising; a sight enclosure tube having front and rear ends and an outer surface, said tube being mounted to the central portion of the bow, a front sight member positioned within said tube adjacent said front end thereof, a rear sight member positioned within said tube and adjacent said rear end thereof, sight rod means for pivotally supporting said front and rear sight member within said tube, and adjustment means mounted along said outer surface of said tube for simultaneously pivotally adjusting said front and rear sight members within said tube, said adjustment means including a pivot means to which said sight rod means is pivotally mounted, an extension member extending from said pivot means, a longitudinally adjustable shaft means connected to said extension member and handle means connected to rotate said shaft means whereby said shaft means may be rotated either forwardly or rearwardly by the pivoting of said handle means to thereby simultaneously adjust said front and rear sight members within said sight enclosure tube.

19. The archery bow of claim 18 in which said longitudinally movable shaft means is threadingly engagable within a block fixedly mounted relative to said outer surface of said sight enclosure tube.

20. The archery bow of claim 18 including a range scale mounted to and extending from said outer surface of said sight enclosure tube adjacent said rear end thereof and a range indicator member extending upwardly from said rear sight member and through said sight enclosure tube so as to be spaced between said range scale and said rear end of said tube.

* * * * *